US008202180B1

(12) United States Patent
Perry-Smith

(10) Patent No.: US 8,202,180 B1
(45) **Date of Patent: *Jun. 19, 2012**

(54) DISC LAUNCHING AND CATCHING DEVICE

(76) Inventor: Randolph T. Perry-Smith, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/016,791

(22) Filed: Jan. 28, 2011

Related U.S. Application Data

(62) Division of application No. 12/124,814, filed on May 21, 2008, now Pat. No. 7,878,929.

(60) Provisional application No. 60/939,779, filed on May 23, 2007.

(51) Int. Cl.
*A63B 59/02* (2006.01)
*A63B 65/12* (2006.01)

(52) U.S. Cl. ..... 473/505; D21/722

(58) Field of Classification Search ..... 473/505, 473/513, 512, 511, 510, 509; 446/486; D21/722–724
See application file for complete search history.

(56) References Cited

U.S. PATENT DOCUMENTS 323,843 A * 8/1885 Armington ..... 473/511
1,156,047 A * 10/1915 Behrend ..... 473/511
1,170,948 A * 2/1916 Achershaug ..... 473/511
2,508,519 A * 5/1950 Jay ..... 473/513
D162,826 S * 4/1951 Harvey ..... D22/135
2,835,494 A * 5/1958 Hull ..... 473/511
3,314,409 A * 4/1967 Olson ..... 124/79
3,342,491 A * 9/1967 Olson ..... 473/511
3,359,678 A * 12/1967 Headrick ..... 446/46
D210,543 S * 3/1968 Nakayama ..... D21/722
3,457,381 A * 7/1969 McMorris ..... 200/50.3
3,666,268 A * 5/1972 Candusso ..... 273/109
3,724,122 A * 4/1973 Gillespie, Sr. ..... 446/46

* cited by examiner

*Primary Examiner* — Gene Kim
*Assistant Examiner* — M Chambers
(74) *Attorney, Agent, or Firm* — Brian D. Smith, P.C.

(57) ABSTRACT

A device for use in launching and catching flying discs includes a frame having a handle section and an open forked section. The opened forked section includes a pair of opposing forks wherein each fork has a distal end and a proximal end with the distal end being free and the proximal end adjoining the proximal end of the opposing fork. Flexible material such as nylon netting is strung between the opposing forks in a manner which enables the formation of a relatively deep elongated channel having an open end so that a forceful swing of the device will cause a flying disc placed in the channel to roll in the channel and out through the open end of the channel at a high rate of speed. A method of using the device to launch a flying disc as well as a novel flying disc are also disclosed.

14 Claims, 3 Drawing Sheets

DISC LAUNCHING AND CATCHING DEVICE

CROSS REFERENCE TO RELATED APPLICATIONS

This application is a divisional application of application Ser. No. 12/124,814, filed May 21, 2008 which, in turn, is a nonprovisional application claiming the benefit under 35 USC 119(e) of U.S. provisional application Ser. No. 60/939,779 filed on May 23, 2007, which is incorporated herein by reference.

FIELD OF THE INVENTION

This invention relates generally to flying discs and more particularly to a novel device for launching and catching a flying disc.

BACKGROUND OF THE INVENTION

A popular sport has developed since the 1960's in which two or more players toss a semi-rigid flying disc (often referred to and sold under the trademark "Frisbee") back and forth to each other. The disc, when spun horizontally, demonstrates certain aerodynamic characteristics and, with skill, one player can toss the disc so that it will follow a prescribed path towards the other player who attempts to catch it in mid-air.

The throwing and catching of the disc is generally done by hand. However, a few devices such as those described in U.S. Pat. No. 4,157,828 and U.S. Design Pat. No. 368,291 have been invented for throwing or launching a flying disc. However, these devices have not had much success, if any, in the marketplace, as far as is known.

Accordingly, it is an object of the present invention to provide a device for launching and catching a flying disc which is fun to use and hopefully will meet with success in the marketplace. Another object of the invention is to provide a hand held disc-launching device which is capable of propelling the disc much greater distances than has been possible in the past. Another object of the invention is to provide a novel flying disc which is capable of traveling much greater distances than those known heretofore.

SUMMARY OF THE INVENTION

The present invention features a device for use in launching and catching flying discs of the type generally known as and sold under the trademark Frisbee. Such a disc is typically thrown by one player to a another player who in turn throws the disc back or to yet a third player.

In its broadest sense, the device includes a frame having a handle section and an open forked section. The opened forked section includes a pair of opposing forks wherein each fork has a distal end and a proximal end with the distal end being free and the proximal end adjoining the proximal end of the opposing fork. In addition, flexible material such as nylon netting is located (strung) between the opposing forks and is attached (strung) to the forks so as to be capable of forming a relatively deep elongated channel having an open end such that a forceful swing of the device will cause a flying disc located in the channel to roll in the channel and out through the open end of the channel at a high rate of speed.

In a preferred embodiment, the forks cooperate with each other so that when the proximal ends of the forks are gripped and squeezed the forks pivot or flex about a pivot point and move inwardly towards each other to form the channel in the flexible material. The forks are also outwardly biased relative to each other so that they spring back about the pivot point to an open position when a player's grip on the forks' proximal is released.

A preferred method of using the above device to launch a flying disc includes gripping and squeezing the proximal ends of the forks so that the forks pivot or flex about the pivot point and move inwardly towards each other to form the channel in the flexible material. The player then places the flying disc in the channel of the flexible material adjacent the proximal ends of the forks. The player then swings the device so that the flying disc rolls in the channel and out through the open end of the channel at a high rate of speed, thereby launching the flying disc and imparting a spinning action to the flying disc as it is launched.

In the embodiment having forks which do not flex or move, a player simply places a flying disc in the channel of the flexible material adjacent the proximal ends of the forks and then swings the device so that the flying disc rolls in the channel and out through the open end of the channel at a high rate of speed.

The present invention also provides a novel flying disc having increased stability when launched and traveling at high speeds which are possible with the device of the present invention. The disc is similar to that known as and sold under the trademark "Frisbee" which has a circular central portion defining a generally flat upper surface and underside surface as well as a rim which circumscribes the circular central portion and which adjoins the central portion via a rounded section of curvature. The increased stability of the disc of the present invention over "Frisbee" type flying discs is provided by a frustoconically shaped section which is axially aligned with the disc's central portion and secured to the central portion at the frustoconically shaped section's larger diameter end.

BRIEF DESCRIPTION OF THE DRAWINGS

The invention will be more readily understood by reference to the accompanying drawings wherein like reference numerals indicate like elements throughout the drawing figures, and in which.

DETAILED DESCRIPTION OF THE PREFERRED EMBODIMENTS

Figure 2:
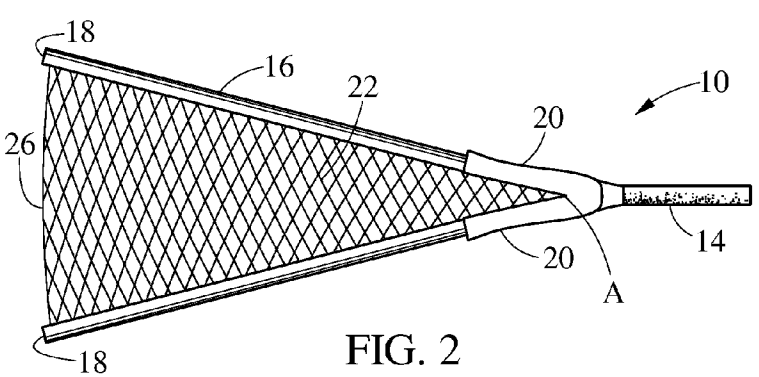
FIG. 2 is a top plan view of FIG. 1.
Figure 3:
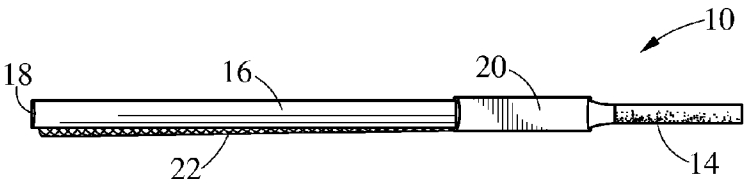
FIG. 3 is a left side elevational view of FIG. 1.

Referring now to the drawings and to FIGS. 1 through 5 in particular, the reference character 10 identifies a generally Y-shaped device 10 for launching a flying disc 12 (shown in FIGS. 4 and 5) comprised of a frame (not numbered) having a handle section 14 and an open forked section (not numbered) which includes a pair of opposing forks 16. As shown, each said fork has a distal end 18 and a proximal end 20 with the distal end 18 being free and the proximal end 20 adjoining the proximal end 20 of the opposing fork at a pivot point A of the device.

Figure 4:
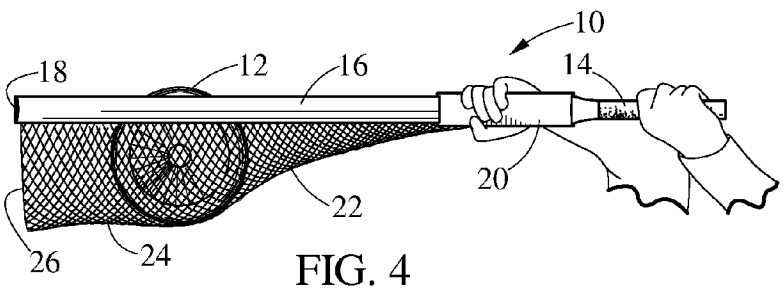
FIG. 4 is a left side elevational view similar to FIG. 3 but showing the device as it would appear after forks 16 are closed in accordance with the method of the invention.
Figure 1:
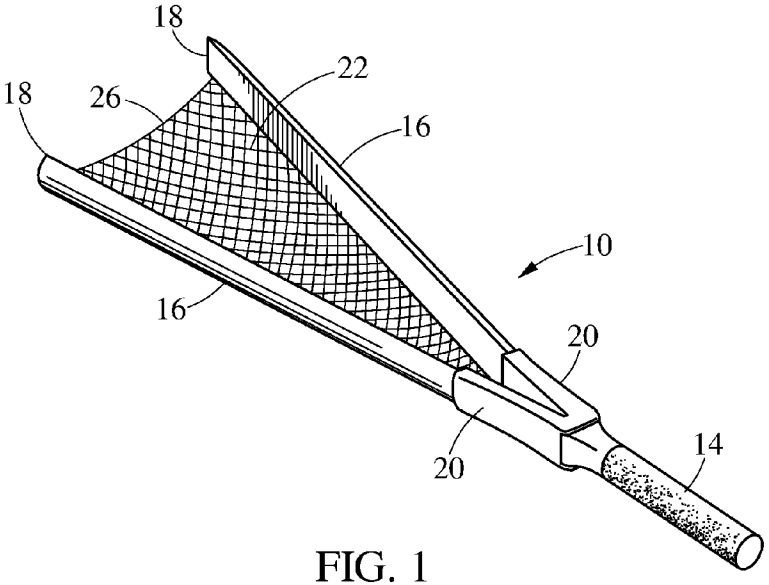
FIG. 1 is a view in perspective of a disc launching and catching device made according to the invention.
Figure 5:
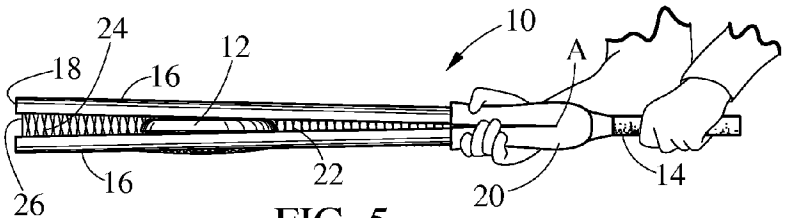
FIG. 5 is a top plan view of FIG. 4.

As also shown, the device includes flexible material such as netting 22 which located between and if it is netting is strung between the forks 16. The strings (not numbered) of netting 22 may be attached to and/or strung between forks 16 by any suitable means known to those skilled in the relevant art such as with hooks, holes or by adhesion. As best visualized by comparing FIGS. 2 and 5, forks 16 cooperate with each other so that when their proximal ends 20 are gripped and squeezed as shown in FIG. 5, the forks pivot or flex about pivot point A and move inwardly towards each other to form a channel 24 having an open end 26 in the netting best as shown in FIG. 4. When a user's grip on the forks' proximal ends 20 is released, forks 16 spring back about the pivot point to their open position shown in FIG. 2 in which the netting is taut. To outwardly bias the springs relative to each other so that they spring back to the open position of FIG. 2, the proximal ends 20 of the forks are preferably made from a resilient elastic material such as PVC (polyvinyl chloride) or ABS plastic (acrylonitrile butadiene styrene). While PVC and ABS are preferred materials, other types of elastic plastics as well as other materials known to those skilled in the art could also be used such as spring steel.

Those skilled in the art will appreciate that as shown in the drawings, forks 16 actually flex about pivot point A since they are made from PVC or ABS. However, forks 16 could easily pivot about point A if forks 16 were connected to each other by a mechanical pivoting hinge mechanism of some sort. As used herein and in the claims appended hereto, "pivoting" includes flexing or any other type of movement which occurs about point A which causes forks 16 to move closer to each other or as also used herein "to close".

As also shown in FIGS. 4 and 5, channel 24 is relatively deep and elongated. Such a deep and elongated channel is desired in accordance with the present invention so that a flying disc located in the channel will roll in the channel and out through the open end of the channel at a high rate of speed when the device is forcefully swung. The deepness of the channel also facilitates holding of disc in the channel so that the plane of the disc is generally perpendicular to the plane in which the forks move and pivot or flex. Perpendicular positioning of the disc in the channel insures that the disc will roll in the channel as the device is swung and will be spinning at a high rate when it exits the open end 26 of the channel. Spinning of the disc is necessary in order to maintain disc stability as the disc travels. A non-spinning disc will typically begin wobbling and, as such, drop very quickly after it is thrown.

To further insure that the disc rolls in the channel of the netting (and does not simply slide in the netting) netting 22 or any other flexible material selected for forming the channel should have enough elasticity so that there is some friction between the rim of the flying disc and the base of channel in which the disc rolls. Without friction, the disc will not roll and will simply slide out of the end 26 of the channel. To this end, it has been found that #252 knotless nylon netting having 1/16 inch diameter string with 1 inch squares works very well.

Figure 8:
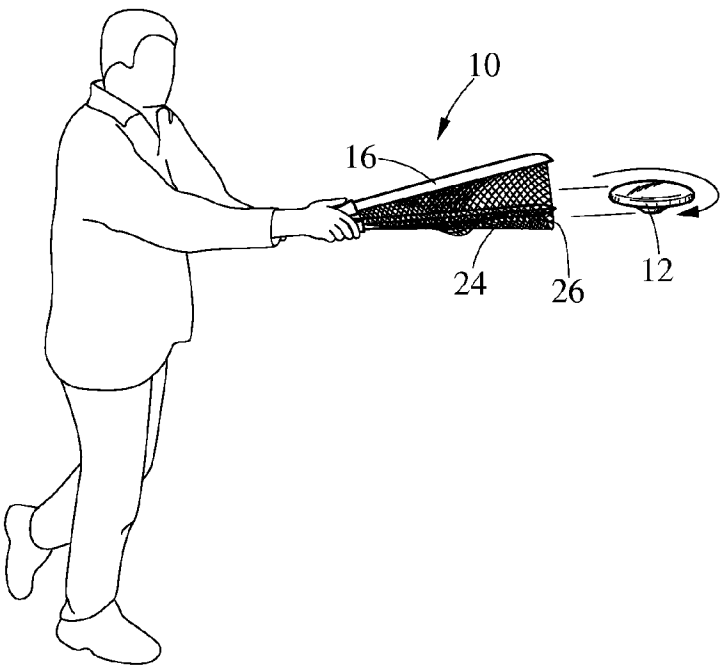
FIG. 8 is a perspective view showing a player at the end of his swing for launching the flying disc which shows the disc just after being launched.
Figure 7:
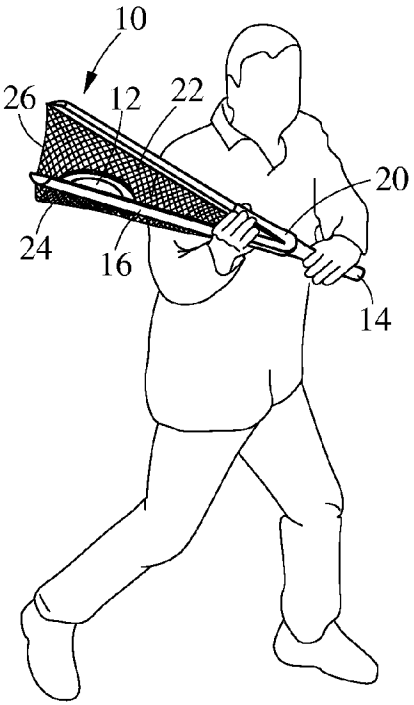
FIG. 7 is a perspective view showing a player about halfway through his swing for launching the flying disc.
Figure 6:
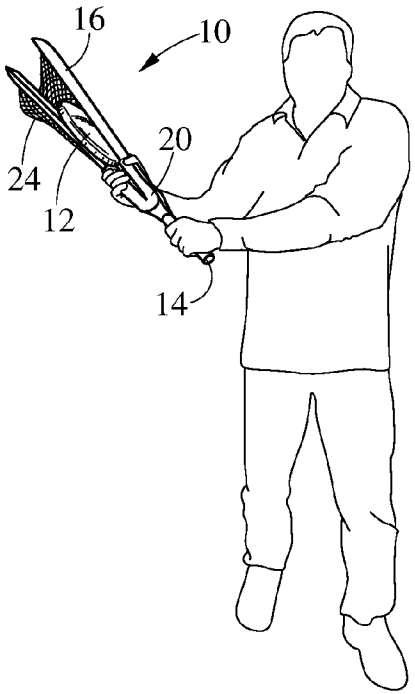
FIG. 6 is a perspective view showing a player beginning to swing the device of FIG. 1 to launch the flying disc.

FIGS. 6-8 illustrate a preferred technique for using device 10 to launch a flying disc 12. As shown in FIG. 6, at the beginning of the user's swing, disc 12 is located in the center of the netting 22 adjacent the proximal ends of the device's forks. In addition, it will be appreciated that the player's left hand is holding handle 14 of the device while the individual's left hand is gripping and squeezing the proximal ends 20 of the forks to move the forks inwardly towards each other as explained above which allows channel 24 to form in the netting. At the mid point of the player's swing which is shown in FIG. 7, it will be appreciated that the disc has begun to roll in the channel towards the open end 26 of the channel. In addition, it will be appreciated that the player has released his grip slightly on the proximal ends 20 of the forks so that the forks have opened slightly at this point in his swing. This opening of the forks causes the netting to tighten slightly which is believed to help accelerate the disc. The acceleration is somewhat similar to what happens when a lacrosse player throws a ball with a lacrosse stick. Finally, FIG. 8 illustrate the position the player will typically be in at the end of his swing just after launching the disc. The arrow above the disc shown in FIG. 8 illustrates that the disc is spinning as it exits end 26 of channel 24 and shows the direction of the spin as well.

Figure 9:
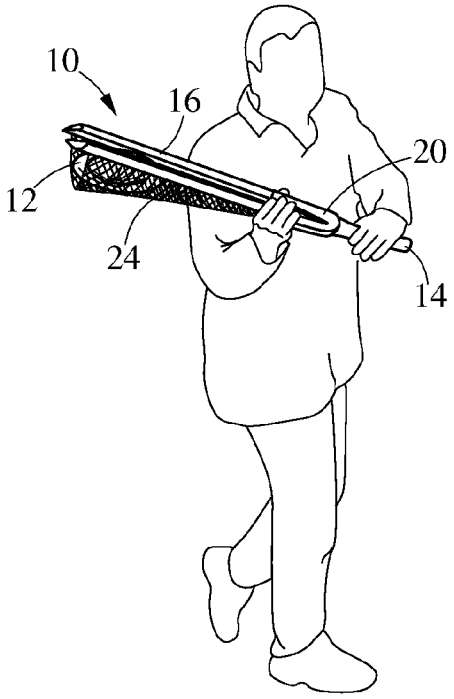
FIG. 9 is a perspective view showing a player after having caught a flying disc with the device of FIG. 1.

FIG. 9 illustrates the position a player would typically be in just after catching a flying, i.e. airborne, disc in the netting of the device. When the disc first contacts the netting the player would typically want the forks of the device to be open since the open position provides the player with a largest possible area of netting with which to catch the disc. However, immediately after the disc contacts the netting, the player will want to close the forks as shown in FIG. 9, i.e. by gripping and squeezing the proximal ends of the forks, to trap the disc in the netting so that it won't fall out of the netting. As such, when the forks are closed the disc will be securely held between the forks and in the channel of the netting.

Figure 10:
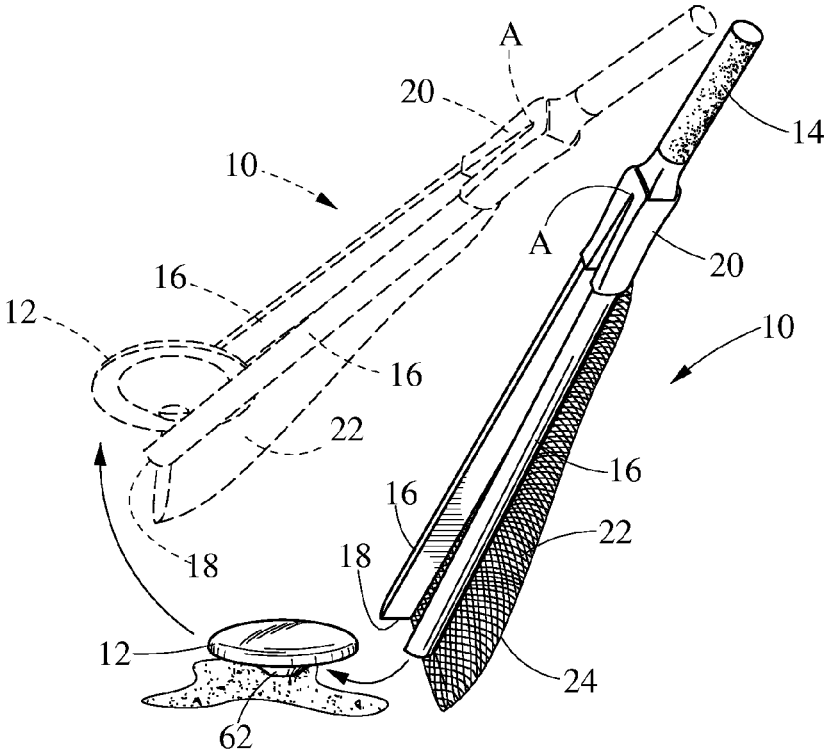
FIG. 10 is a perspective view showing use of the device to pick up a flying disc located on the ground.

FIG. 10 is intended to illustrate the process of using device 10 to pick up a flying disc 12 located on the ground. As can be visualized from FIG. 10, a player begins the process by partially closing the forks, again by gripping and squeezing the proximal ends of the forks. The player then slides the free distal ends of the device's forks under the disc so that the disc is located between the forks' distal ends. The player then grips and squeezes the proximal ends of the forks to close the forks so that the disc is pinched between the distal ends of the forks as shown in phantom in FIG. 10. The pinched disc is then lifted off the ground and raised to a height where it is easily grabbed and removed from the device by the player, and as the player removes the disc from the device he/she would also release his/her grip on the proximal ends of the device so that the forks release the disc.

Figure 11:
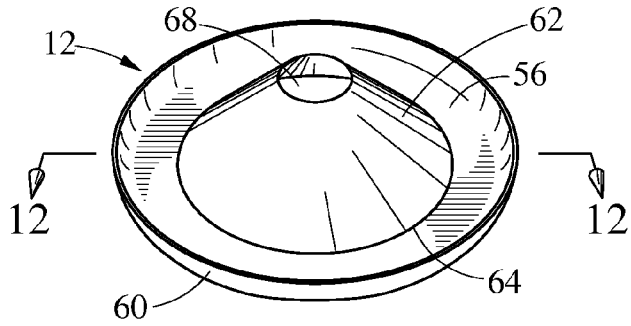
FIG. 11 is a view in perspective showing the flying disc of the present invention.
Figure 12:
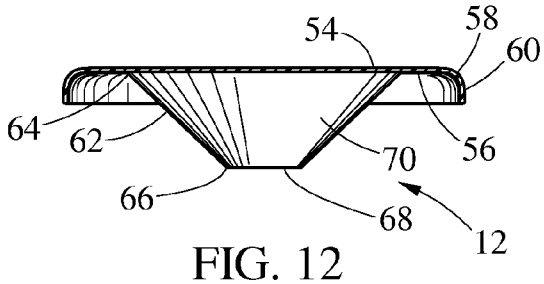
FIG. 12 is an upside down cross-sectional view taken along lines 12-12 of FIG. 11.

FIGS. 10-12, particularly FIGS. 11 and 12, illustrate in detail the novel flying disc 12 provided by the present invention which is not only easy to pick up and pinch as described above but which also has increased stability when launched and traveling at the high speeds possible with the device of the present invention. As shown, disc 12 is of the type which has a generally conventional circular central portion 54 defining a generally flat upper surface (not numbered) and a generally flat underside surface 56. The disc is also provided with a generally conventional rounded section 58 of curvature which adjoins central portion 54 and curves downwardly to a point of juncture with a rim 60 of the disc which circumscribes the circular central portion.

The primary improvement provided by the flying disc of the present invention over conventional heretofore known flying discs is the provision of a frustoconically shaped section 62 which has a larger diameter end 64 and a smaller diameter end 66 and which is secured to the underside surface 56 of the central portion 54 at its larger diameter end 64 as shown in FIGS. 11 and 12. From the figures, it will also be appreciated that frustoconically shaped section 62 is axially aligned with the disc's central portion 54. In addition, it will be appreciated that the smaller diameter end 66 defines a hole 68 in communication with the interior of the frustoconically shaped section so as to provide the flying disc with a vented interior chamber 70. Hole 68 could be sealed but it has been found that by opening it, disc 12 produces a pleasing whirling sound that enhances the enjoyment associated with playing with and launching disc 12. In addition, while frustoconical section 62 is described above as being secured to the underside of central portion 54, it is preferably integral therewith, i.e. of unitary construction or one piece.

While the invention has been described with particular reference to the illustrated embodiments, numerous modifications thereto will appear to those skilled in the art without departing from the spirit of the invention. For example, the launcher, while primarily adapted for use as a game device, could be used to throw or launch other disc-shaped objects such disc-shaped packages, grenades and life lines wrapped about flat spools or the like.

I claim:

1. A device for launching a flying disc comprising:

a frame having a handle section and an open forked section, said opened forked section including a pair of opposing forks wherein each said fork has a distal end and a proximal end with the distal end being free and the proximal end adjoining the proximal end of the opposing fork at a pivot point; and, flexible material located between said opposing forks and being attached to said opposing forks so as to be capable of forming a relatively deep elongated channel having an open end such that a forceful swing of the device will cause a flying disc located in the channel to roll in the channel and out through the open end of the channel at a high rate of speed, and wherein said forks cooperate with each other so that when the proximal ends of said forks are gripped and squeezed the forks pivot about the pivot point and move inwardly towards each other to form said channel in said flexible material, said forks further being outwardly biased relative to each other so that they spring back about the pivot point to an open position when a user's grip on the forks' proximal is released.

2. A device as claimed in claim 1 wherein at least one of said forks includes resilient elastic material which outwardly biases said forks relative to each other.

3. A device as claimed in claim 2 wherein said resilient elastic material is ABS or PVC.

4. A device as claimed in claim 1 wherein at least one of said forks includes spring steel which outwardly biases said forks relative to each other.

5. A device as claimed in claim 1 wherein said flexible material located between the opposing forks is taut when the forks spring back to their open position.

6. A device as claimed in claim 1 wherein said flexible material is netting.

7. A device as claimed in claim 1 wherein said netting is nylon netting.

8. A device as claimed in claim 1 wherein said forks flex about the pivot point.

9. A device as claimed in claim 1 wherein the frame is generally Y-shaped with the handle section provided by the lower section of the Y and the opened forked section provided by the upper section of the Y.

10. A flying disc of the type for throwing through the air for use with the device of claim 1 which includes:

a circular central portion defining a generally flat upper surface and a generally flat underside surface; a rim circumscribing the circular central portion; and, a section of curvature adjoining said central portion curving downwardly to a point of juncture with said rim; and, wherein the improvement comprises a frustoconically shaped section having a larger diameter end and a smaller diameter end and wherein said larger diameter end is secured to said underside surface of said circular central portion such that said frustoconically shaped section is axially aligned with said circular central portion, said smaller diameter end defining a hole in communication with the interior of said frustoconically shaped section so as to provide the flying disc with a vented interior chamber.

11. A flying disc as claimed in claim 10 in which said disk has a unitary construction.

12. A method of catching an airborne flying disk, with the device of claim 1, said method comprising:

a frame having a handle section and an open forked section, said opened forked section including a pair of opposing forks wherein each said fork has a distal end and a proximal end with the distal end being free and the proximal end adjoining the proximal end of the opposing fork at a pivot point; and, flexible material located between said opposing forks and being attached to said opposing forks so as to be capable of forming a relatively deep elongated channel having an open end such that a forceful swing of the device will cause a flying disc located in the channel to roll in the channel and out through the open end of the channel at a high rate of speed, and wherein said forks cooperate with each other so that when the proximal ends of said forks are gripped and squeezed the forks pivot about the pivot point and move inwardly towards each other to form said channel in said flexible material, said forks further being outwardly biased relative to each other so that they spring back about the pivot point to an open position when a user's grip on the forks' proximal ends is released, providing an airborne flying disc;

catching the airborne flying disc in the flexible material of the device with the forks of the device in a generally open position and then immediately gripping and squeezing the proximal ends of the forks of the device to close the forks so that the disc is held between the forks and in the channel of the flexible material formed by closing the forks.

13. A method as claimed in claim 12 wherein the flying disc is located on the ground, said method further comprising:

picking up the flying disc located on the ground by:

sliding the free distal ends of the device's forks under the disc so that the disc is located between the forks' distal ends; and then, gripping and squeezing the proximal ends of the forks to close the forks so that the disc is pinched between the distal ends of the forks; and then, lifting the pinched disc off the ground; and then, raising it to a height where the disc is easily grabbed and removed from the device by the player; and, releasing one's grip on the proximal ends of the device so that the forks release the disc; and, grabbing and removing the disc from the device.

14. A method of launching a flying disc using the device of claim 1, said method comprising:

a frame having a handle section and an open forked section, said opened forked section including a pair of opposing forks wherein each said fork has a distal end and a proximal end with the distal end being free and the proximal end adjoining the proximal end of the opposing fork; and, flexible material located between said opposing forks and being attached to said opposing forks so as to be capable of forming a relatively deep elongated channel having an open end such that a forceful swing of the device will cause a flying disc located in the channel to roll in the channel and out through the open end of the channel at a high rate of speed;

placing a flying disc in the channel of the flexible material adjacent the proximal ends of the forks; and, swinging the device so that the flying disc rolls in the channel and out through the open end of the channel at a high rate of speed, said swinging action thereby launching the flying disc and imparting a spinning action to the flying disc as it is launched.

* * * * *